United States Patent [19]

Arnoldy

[11] 4,210,289

[45] Jul. 1, 1980

[54] TUB GRINDER CONTROL

[76] Inventor: Adrian F. Arnoldy, Tipton, Kans. 67485

[21] Appl. No.: 972,794

[22] Filed: Dec. 26, 1978

[51] Int. Cl.[2] ..... B02C 13/286; B02C 25/00

[52] U.S. Cl. ..... 241/27; 241/35; 241/73; 241/101.7; 241/186.2; 241/186.4; 241/189 R

[58] Field of Search ..... 241/27, 34, 35, 30, 241/186 R, 186.2, 186.4, 189 R, 101.7, 194, 73; 267/136, 137

[56] References Cited

U.S. PATENT DOCUMENTS

| | | | |
|---|---|---|---|
| 1,137,272 | 4/1915 | Moyle | 267/137 |
| 2,732,138 | 1/1956 | Forth | 241/34 X |
| 2,747,859 | 5/1956 | Rager | 267/136 |
| 2,908,491 | 10/1959 | Suozzo | 267/136 |
| 3,528,616 | 9/1970 | Krolopp et al. | 241/34 |
| 3,912,175 | 10/1975 | Anderson | 241/101.7 X |
| 3,966,128 | 6/1976 | Anderson et al. | 241/73 |
| 4,033,515 | 7/1977 | Barcell et al. | 241/27 |
| 4,106,706 | 8/1978 | Burrows | 241/186.4 X |

OTHER PUBLICATIONS

Haybuster Parts Book, Haybuster Manufacturing, 12-1978.

*Primary Examiner*—Mark Rosenbaum
*Attorney, Agent, or Firm*—Fishburn, Gold and Litman

[57] ABSTRACT

A tub grinder suitable for comminuting forage crops as feed for livestock comprising a rotating circular tub having a floor with an opening therein through which a hammermill communicates for chopping the forage. When the forage is fed too quickly and overloads the hammermill, a governor senses that the rotational speed of the hammermill has been reduced and operatively signals the tub driving mechanism to slow the speed thereof, thus feeding forage at a lesser rate and allowing the hammermill to recover. A similar but opposite process occurs when the hammermill increases in speed to the extent that it is able to handle additional forage. A dampening mechanism is used in conjunction with the governor and functions to allow the tub rotation to slow immediately upon the hammermill being overloaded, but somewhat delays the increase of the tub rotation when the hammermill can receive additional forage. The operation of the dampening mechanism reduces apparatus damaging oscillations which are commonly found in conventional machinery of this type.

6 Claims, 7 Drawing Figures

Fig. 1.
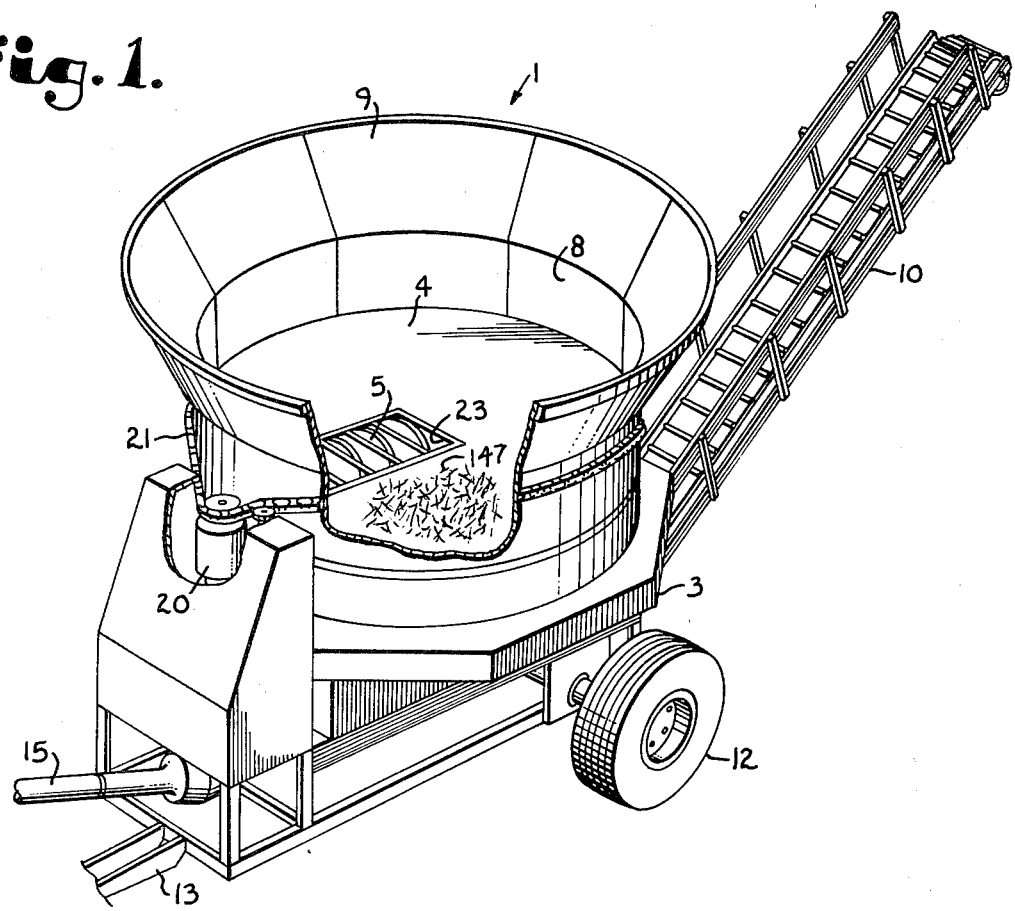
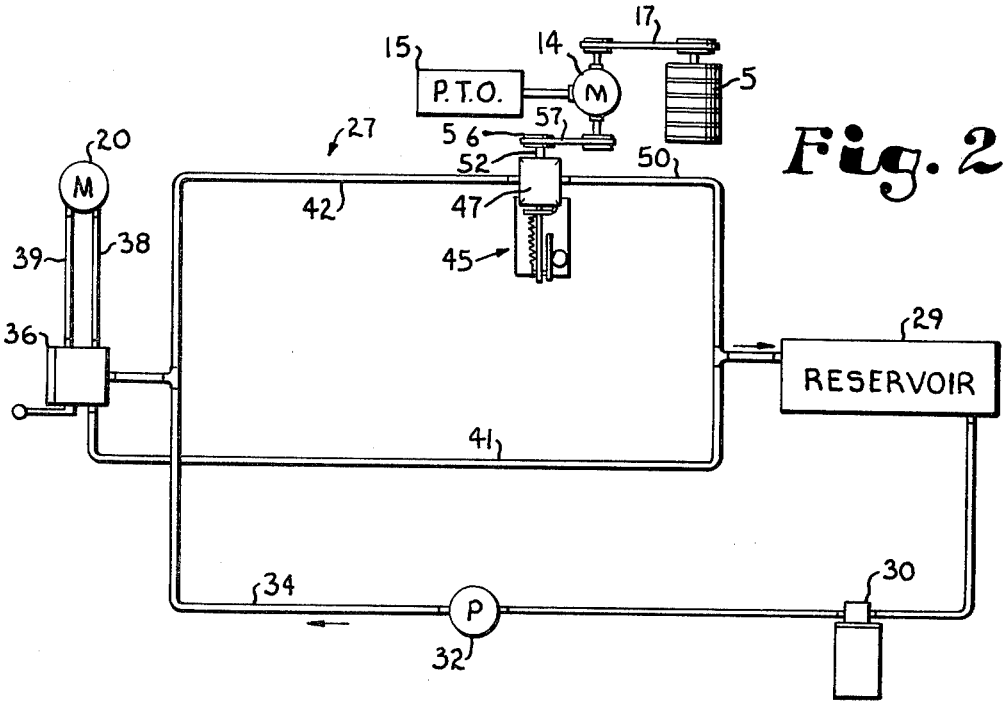
Fig. 2.

Fig. 3.
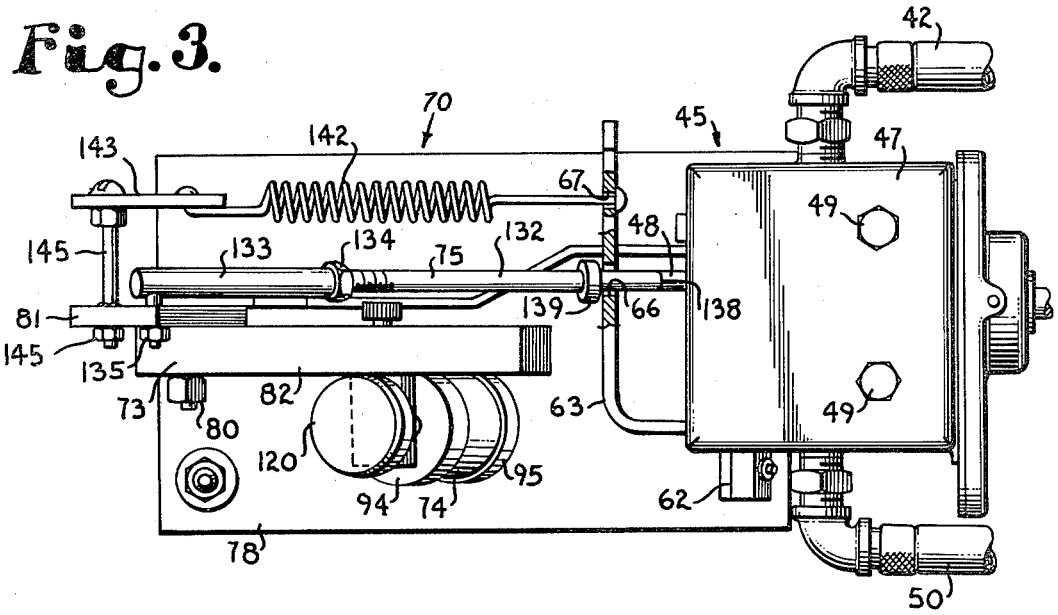
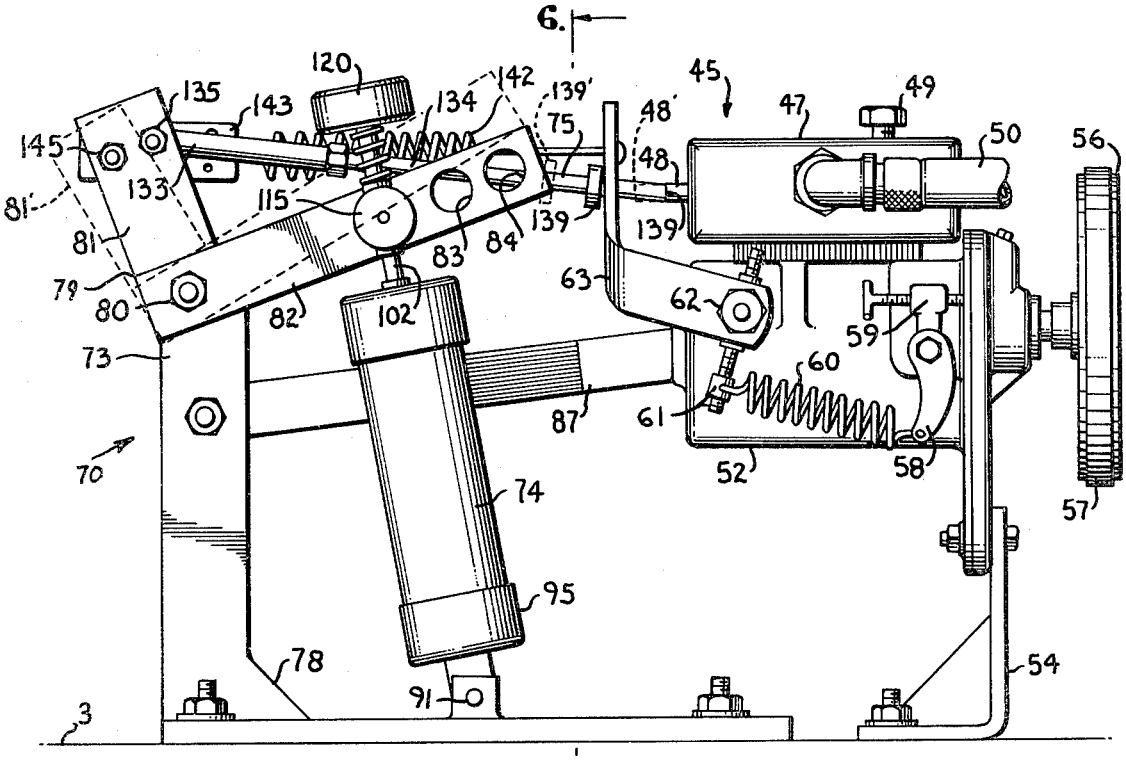
Fig. 4.

TUB GRINDER CONTROL

BACKGROUND OF THE INVENTION

The present invention relates to a tub grinder in which the rotational speed of the tub is slaved to the rotational speed of the hammermill, and in particular, to use of a control mechanism with such a tub grinder which substantially dampens or slows the rotational acceleration of the tub in relationship to the hammermill, but allows the tub to decelerate rapidly in direct relation to the deceleration of the hammermill.

The prior art discloses a number of tub grinders among which are included U.S. Pat. No. 3,912,175 to Anderson, U.S. Pat. No. 3,966,128 to Anderson et al and U.S. Pat. No. 4,033,515 to Barcell et al. The basic concept for the tub grinder involves the placement of forage in a rotating tub which urges the forage to pass over an opening in a floor beneath the tub. A hammermill extends through the opening, terminating slightly above the floor, and rotates so as to grind the feed into small pieces, whereby livestock may feed more easily thereon and there is less wastage thereof. The hammermill is often driven by a power take-off from a farm vehicle, although some units have a self contained power source. When the tub rotates too fast and thus overloads the hammermill, thereby slowing same, efficiency is lost and actual damage may be done to the machinery of the hammermill and/or farm vehicle supplying the power. Thus, a governor is normally included in such tub grinders, so as to slave the rotation of the tub to the speed of the hammermill, such that rotation of the tub is decelerated whenever the hammermill becomes chocked or is slowed and accelerated whenever the hammermill is able to accept more forage.

The major problem associated with the above described conventional tub grinders is that the rotation of the tub often begins to oscillate between acceleration and deceleration rather than maintaining a somewhat optimum constant speed and such oscillations often gain in amplitude with each cycle. The tub grinders, while designed to be sturdy in construction, are not able to withstand such oscillations over a long period of time and thus fail rapidly. Even if the tub grinder is able to withstand the oscillations, the power take-off system of the farm implement may be damaged. Thus it is desired to somehow effect a more stable rotational speed in the tub, yet leaving the tub to still be slaved to the hammermill, so that the hammermill will not be overloaded. The prior art reveals a number of indirect devices such as baffles, plates, and crossover bars to induce forage to feed more evenly to the hammermill. These devices have had varying degrees of effectiveness. However, a more direct mechanism has been needed which dampens the oscillations to prevent overload and seeks efficient operating conditions.

In addition, a dampening mechanism is desired which will not hamper deceleration or the complete stoppage of the tub, such that if the hammermill does become overloaded or choked with forage, the tub rotation will cease quickly before serious damage is done to the hammermill and/or power source. Thus, preferably a dampening system allows immediate proportional deceleration of the tub rotation with respect to the hammermill rotation but substantially delays the acceleration of the rotation of the tub or will accelerate the tub at a rate less than in proportion to the acceleration or speed of the hammermill.

OBJECTS OF THE INVENTION

Therefore, the principal objects of the present invention are: to provide a tub grinder wherein the tub rotation is slaved by means of a governor to the rotational speed of the hammermill and has a dampening control mechanism which reduces or eliminates oscillations within the rotational speed of the tub; to provide such a control mechanism which comprises a dampener in an operative relationship to the governor; to provide such a dampener which allows immediate deceleration or stopping of the rotation of the tub in direct relationship to the rotational speed of the hammermill but which accelerates the speed of the rotation of the tub less than in proportion to increases of the rotational speed of the hammermill; to provide such a dampener which utilizes a hydraulic cylinder with a plunger mounted therein and having substantially non-obstructed flow of the hydraulic fluid around the plunger in a direction so as to allow immediate slowing down of the rotational speed of the tub but which has only a small aperture through which hydraulic fluid can pass in the opposite direction so as to significantly delay the acceleration of the rotation of the tub; and to provide such a dampener to be used in combination with tub grinder which is easy to use, economical to produce, capable of extending the useful life of the tub grinder, and particularly well suited for the proposed usage thereof.

Other objects and advantages of this invention will become apparent from the following description taken in connection with the accompanying drawings wherein are set forth, by way of illustration and example, certain embodiments of this invention.

The drawings constitute a part of this specification including exemplary embodiments of the present invention and illustrate various objects and features thereof.

BRIEF DESCRIPTION OF THE DRAWINGS

FIG. 1 is a perspective view of a tub grinder including a rotary tub and a hammermill.

FIG. 2 is a schmematic diagram of a hydraulic system which rotates the tub and including a hydraulic fluid bypass governor with a dampener mechanism therefor.

FIG. 3 is a top plan view of the governor with the dampener mechanism.

FIG. 4 is a front elevational view of the governor with the dampener mechanism, including a phantom view of parts of the governor showing movement thereof.

DETAILED DESCRIPTION OF THE PREFERRED EMBODIMENTS

Figure 5:
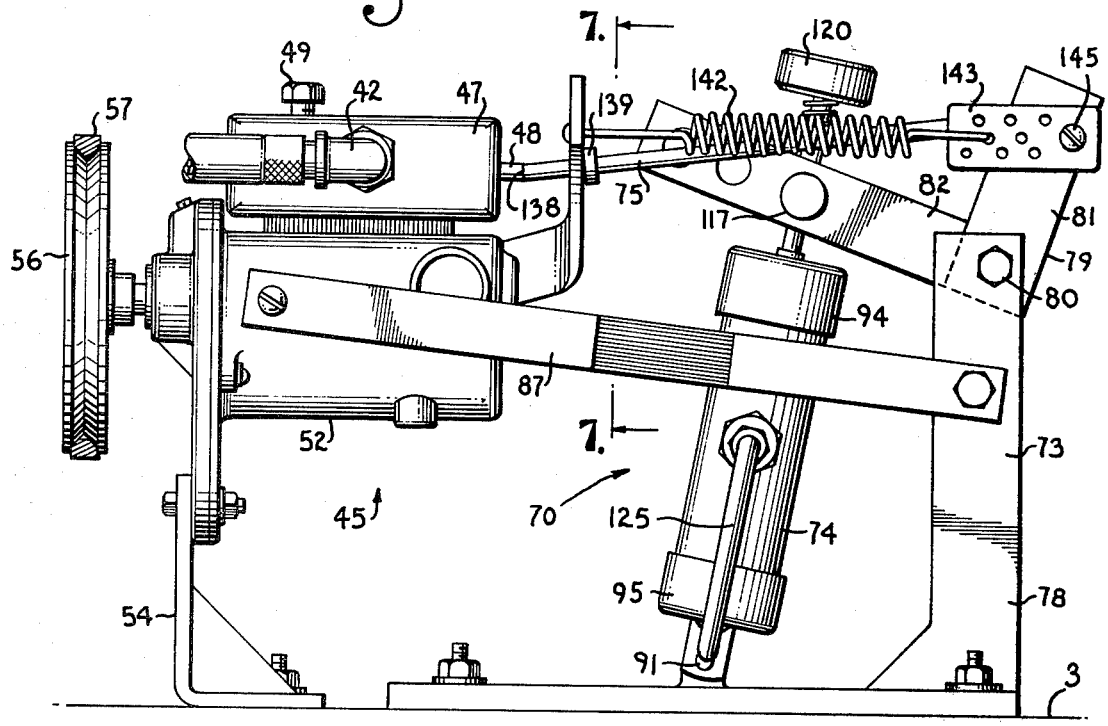
FIG. 5 is a rear elevational view of the governor with the dampener mechanism.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In general, the present invention comprises a tub grinder having a dampening control mechanism which prevents grinder mechanism overloading and substantial oscillations in the rotational speed of various moving parts thereof.

A tub grinder 1 is generally illustrated in FIG. 1. The tub grinder 1 comprises a base frame 3 having a relatively flat upper surface 4, a hammermill 5, a cylinder, chamber or tub 8 having a flared upper section 9 and a conveyor 10. The base frame 3, as illustrated, is mobile having wheels 12 and a towing hitch 13 for attachment to a self-propelled transporting vehicle (not shown). The base frame 3 houses a hammermill prime mover mechanism 14 for the hammermill 5 (shown schematically in FIG. 2). Power is supplied to the hammermill prime mover mechanism 14 by a power take off device 15 from a conventional source (not shown). The power is transfered to the hammermill 5 by a drive mechanism 17 comprising conventionally known sheaves and drive belts. The cylinder 8 is mounted on the surface of the base frame 4 in a conventional manner so as to be rotatable about the central axis thereof. The cylinder 8 rotation is controlled and powered by a cylinder prime mover mechanism or motor 20 which is separate from the hammermill prime mover mechanism 14 and is specifically connected to and rotates the cylinder 8 by means of a drive chain 21. The base frame surface 4 has a rectangular aperture 23 therein through which an upper portion of the hammermill 5 extends, such that the upper arc of the hammermill 5 enters the volume encircled by the cylinder 8. The conveyor 10 is situated such that the one end thereof receives the discharge from the hammermill 5, which discharge is then conveyed to an opposite end suitable for distribution of the discharge.

Although a specific tub grinder 1 has been illustrated herein, it is foreseen that many modifications could be made to the structure, for example, a tub grinder under the purview of the present invention may include: a total internal power supply, self-propulsion, variations in the shape of the tub, etc.

The tub or cylinder motor 20 has a hydraulic system 27, as best seen in the schematic diagram in FIG. 2, associated therewith. Hydraulic fluid is stored in a reservoir 29 from which it is fed through a filter 30 to a pump 32. The hydraulic fluid exits the pump through conduit 34 and enters a switching station or manual control mechanism 36 for the motor 20 (except when the hydraulic fluid bypasses the switching station 36, as will be described later). When the switching station 36 is set for forward rotation of the tub 20, the hydraulic fluid is fed to the motor 20 through conduit 38 and returns to the switching station through conduit 39. The flow of hydraulic fluid may be manually bypassed around motor 20 by selectively adjusting the switching station 36 to return the hydraulic fluid to reservoir 29 through conduit 41 without entering the motor 20. The return flow of the hydraulic fluid from the motor 20 also passes through the conduit 41. An alternate route for the hydraulic fluid from the pump 32 is through conduit 42. Passage of the hydraulic fluid through conduit 42 is controlled by a governor mechanism 45 through a bypass mechanism 47. The bypass mechanism 47 encloses a simple mechanical valve (not shown) which is spring biased to open, accompanied by the extension of a plunger 48. Thus, bypass of fluid is permitted while the plunger 48 is extended. The bypass mechanism 47 is attached to the remainder of the governor mechanism 45 by a pair of bolts 49. The hydraulic fluid will preferentially bypass the switching station 36 and motor 20 and pass through the bypass mechanism 47 when the bypass valve therein is open. Hydraulic fluid from the bypass mechanism 47 returns to the reservoir 29 through the conduit 50.

In conventional tub grinders the plunger 48 on the bypass mechanism 47 is normally operatively positioned by the governor transducer 52. In general the transducer 52 receives a signal imput from the hammermill prime mover mechanism 14 proportional to the rotational speed of the hammermill 5 and transduces this signal so as to increase the flow of the hydraulic fluid through the bypass mechanism 47 whenever the hammermill 5 begins to slow down or decelerate, thus, reducing the rotational speed of the motor 20 and consequentially decelerating the rotational speed of the tub 8. When the hammermill 5 increases in rotational speed, the valve on the bypass mechanism 47 is operatively partially or completely shut, blocking flow of hydraulic fluid through the conduits 42 and 50 and increasing fluid flow to the motor 20, thus increasing the speed of the motor 20 and consequently the rotational speed of the tub 8.

In the illustrated embodiment the signal imput to the transducer 52 which is mounted on the support 54 is generated by a drive pulley 56 which is rotated by a V-belt 57 which in turn is rotated by connection and rotation with the hammermill prime mover mechanism 14. The transducer 52 has an output arm 58 which is positioned relative to the rotational imput from the pulley 52 and fine adjusted by a tension mechanism 59. A spring 60 connects the output arm 59 to an adjustable lever positioning bar 61 which in turn is pivotally connected by a bolt 62 to a lever arm 63. The lever arm 63 is bent so that the free end thereof ends in close proximity to the bypass mechanism plunger 48. The lever arm 63 has apertures 66 and 67 therethrough (FIG. 3), the purpose of which will be discussed hereinafter.

A dampening mechanism 70 operatively connects the transducer 52 through the lever arm 63 thereof to the bypass mechanism 47 through the plunger 48 thereof. The dampening mechanism according to the present example, comprises means for dampening or delaying the rotational acceleration of the motor 20 and consequently the tub 8 whenever the hammermill 5 experiences an increase in the rotational speed thereof but allows substantially immediate stopping, deceleration or slowing down of the tub 8, whenever the hammermill 5 stops or decelerates in rotational speed. In the illustrated embodiment, as best seen in FIGS. 3, 4, 5 and 6, the dampening mechanism 70 comprises a frame 73, a hydraulic cylinder 74 and a control rod 75.

The dampening mechanism frame 73 has a base structure 78 fixedly attached to the tub grinder frame 3. A L-shaped lever arm 79 is pivotally mounted near the top (as seen in FIG. 4) of the base structure 78 by pivot pin 80. Members 81 and 82 join near and extend outwardly from the pin 80. The member 82 has large, spaced apertures 83 and 84 (and a third not shown) near the free end thereof. A cross brace 87 is fixedly attached to the base structure 78 and transducer 52 and maintains a constant relative distance therebetween.

Figure 6:
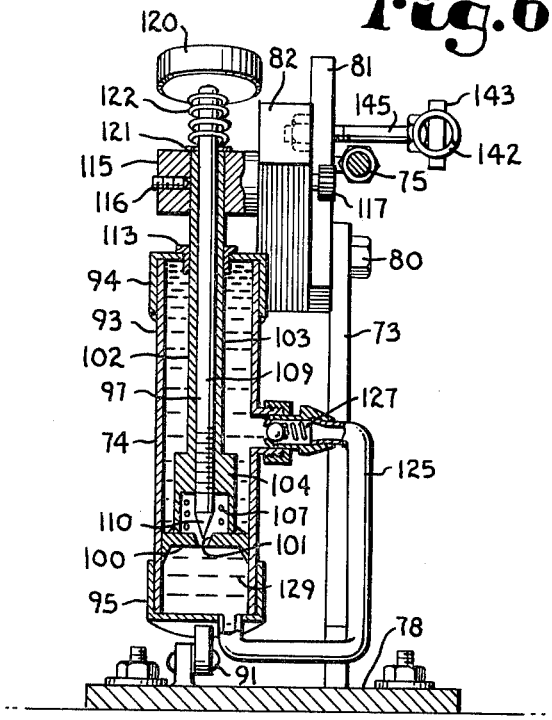
FIG. 6 is a cross-sectional view taken along the line 6—6 of FIG. 4 wherein parts of the dampener mechanism are broken away to show the interior thereof.
Figure 7:
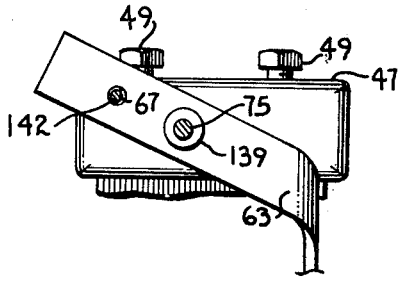
FIG. 7 is a cross-sectional view taken along the line 7—7, of FIG. 5.

The hydraulic cylinder 74 is pivotally attached to the base structure 78 by a pivot pin 91. The hydraulic cylinder 74, as is best seen in FIG. 6, comprises a main annular section 93, a top cap 94 and a bottom cap 95. Slidably and sealibly mounted within the hydraulic cylinder main section 93 is a plunger 97 having a piston 100 with an aperture 101 therein and a shaft 102. The shaft 102 comprises an outer annulus 103 having (as seen in FIG. 6) a lower expanded portion 104 which is secured to the top of the piston 100. A lower end of the shaft lower portion 104 has perforations 107 therein. An inner rod 109 is mounted within the shaft outer annulus 103 and is threadably interconnected therewith. The lower end 110 of the inner rod 109 is tapered so as to mate with the opening 101 in the piston 100. The shaft 102 is slidably sealed about the cylinder top cap by the seal 113.

A connecting bar 115 is fixedly positioned by a set screw 116 in relation to the upper end of the inner rod 109 and extends outwardly perpendicular thereto. The connecting bar 115 extends through one of the apertures 83, 84, etc. in the member 82 and is pivotally held therein by a fastener 117. A turning knob 120 is fixedly mounted on the top of the inner rod 109. The shaft outer annulus 103 terminates at the top of the connecting bar 115 and is sealed thereat by a seal 121 biased into place by a spring 122 which urges against the knob 120 and the seal 121. A bypass device or conduit 125 connects the bottom cap 95 with a central portion of the hydraulic cylinder annulus 93 at a central position therealong above the uppermost position of the piston 100 therein. A check valve 127 allows flow of a fluid through the bypass conduit 125 only in a downward direction (as seen in FIG. 6).

Hydraulic fluid 129 fills the hydraulic cylinder 74 and bypass conduit 125. Thus when the inner rod tapered end 110 is unseated from the piston aperture 101, hydraulic fluid 129 will flow through the aperture 101 and apertures 107 from one side of the piston 100 to the other when pressure is exerted on the piston 100. In addition, the hydraulic fluid 129 will flow through the check valve 127 and the bypass conduit 125 when upward pressure is placed upon the piston 100.

The control arm 75 has an inner section 132 and an outer section 133 threadably connected together and adjustable with respect to each other so as to fine adjust length thereof, locking being accomplished by a nut 134. The control arm 75 is pivotally attached at one end to the member 81 by a pivot bolt 135. The opposite end of the control arm extends through the aperture 66 on the lever arm 63 and has a termination or tip 138 which engages the bypass mechanism plunger 48. A ring 139 is fixedly attached to the control arm 139 prevents the control arm 75 from passage through the aperture 66 beyond a preadjusted point. An elongate resilient member or spring 142 is attached at one end thereof to the lever arm 63 at the aperture 67. The opposite end of the spring 142 is connected to a plate 143 having a plurality of apertures therein which allow selective adjustment of the tension on the spring 142. The plate 143 is pivotally connected to the member 81 by a pivot bolt 145.

In use, the tub grinder 1 is first positioned in a suitable location. The power take off device 15 is connected to a hammermill prime mover mechanism 14 which is rotated thereby. The power take off device 15 operatively rotates the hammermill 5 which is in turn sensed by the transducer 52 on the governor mechanism 45 by means of rotation of the pulley 56 attached thereto and operatively rotating proportionally to the hammermill 5. The transducer 52 repositions the lever arm 63 so that the free end thereof approaches the bypass mechanism plunger 48. This movement of the lever arm 63 in turn increases tension on the spring 142 which in turn pulls the top of the L-shaped arm member 81 toward the right (as seen in FIG. 4). As the L-shaped arm 79 is rotated clockwise about the pivot bolt 80 the end of the member 81 and hence the hydraulic cylinder shaft 102 are urged downwardly. This creates pressure on the piston 100 to move downwardly though the hydraulic fluid 129, but it is only free to move as quickly as the hydraulic fluid 129 can be displaced upwardly through the apertures 101 and 107 (as seen in FIG. 6). The flow rate of the hydraulic fluid 129 through aperture 101 is selectively adjusted by positioning the tapered end 110 of the shaft interior rod 109 closer or further from the aperture 101, thus this functions as a needle valve in restricting flow. As the hydraulic fluid 129 flows from below to above the piston, the shaft 102 is able to move downwardly. This in turn allows the members 81 and 82 to rotate clockwise. The control rod 78 is thereby pushed to the right (as seen in FIG. 4) such that the termination 138 thereof urges the bypass mechanism plunger 48 inwardly thereby closing the bypass valve.

Meanwhile the pump 32 of the tub motor hydraulic system 27 (as seen in FIG. 2) has been started. The hydraulic fluid in the reservoir 29 is initially pumped by pump 32 through conduits 34, 42 and 50 back to the reservoir, as long as the valve in the bypass mechanism 47 is in an open position. When the bypass mechanism plunger 48 is depressed as discussed above, then the hydraulic fluid starts to flow through the motor 20 provided that the manual switching station 36 is properly set to selectively direct the fluid through the motor 20. The motor 20 then rotates the tub 8. In general, the tub 8 rotates at a speed somewhat proportional to the depression of the plunger 48. Thus the faster the hammermill 5 rotates the further the plunger 48 will be depressed and the faster the tub 8 will rotate, however, there is a delay dampening in the acceleration of the rotational speed of the tub 8, basically determined by how fast the hydraulic fluid 129 flows through the piston 100 (FIG. 6), consequentially allowing the control rod 75 to depress the plunger 48. Adjustments can be made to fine tune the governer 45 and especially the dampening mechanism 70 by adjusting the transducer tension control 59, the distance from the pivot point 62 to whereat the transducer spring 60 attaches to the bolt 61, the aperture whereat the spring 142 attaches to the plate 143, the aperture (e.g. 83, 84, etc.) whereat the hydraulic cylinder connecting bar 115 connects to the member 82, the length of the control arm 75, and the distance of the shaft inner rod tapered end 110 from the piston aperture 101.

Livestock feed is placed in the rotating tub 8 and is urged toward the hammermill 5 by the rotation thereof.

Whenever the hammermill 5 becomes chocked or overloaded so that the speed of rotation thereof decreases the above process is reversed except as follows. The lever arm 63 pushes outwardly against the stop or enlargement 139 on the control rod 75, which in turn positively rotates the L-shaped arm 79 counterclockwise (as seen in FIG. 4) about the pivot bolt 80 thereby urging the shaft 102 upwardly. This action creates a repositioning of the central rod expanded portion 139 thereby relocating the control rod tip 48 and permits the internal spring loading in the bypass mechanism 47 to extend the plunger 48. One example of this action is shown by broken lines in FIG. 4, in which the various parts showing movement are designated by the corresponding number of the originally positioned parts with primes (i.e., 48', 81' and 139'). Although the small aperture 101 in the piston 100 resists the flow of large amounts of hydraulic fluid 129, the bypass conduit 125 does not. Therefore the hydraulic fluid 129 can flow almost immediately from above to below the piston 100 (as seen in FIG. 6) without substantial delay. Hence the spring loaded plunger 48 depresses or opens almost instanteously as the hammermill 5 slows down.

Thus the governor 45 according to the present invention allows the tub 8 rotation to be slaved (that is basically follow in proportion) to the hammermill 8 rotational speed especially as the hammermill 8 slows down or decelerates so that the machine is not damaged. However, on startup or acceleration of the hammermill 8, the consequent acceleration of the tub 8 is dampened or delayed so that the risk of sudden overload is reduced. This substantially reduces the opportunity for oscillations otherwise induced in the system. This reduction in opportunity for oscillation appears to significantly increase the life of the parts of the tub grinder 1, the prime mover mechanism 14 that provides power to the hammermill 5 and any external power source therefor.

The present invention also provides a method of grinding livestock feed comprising placing feed 147 into a tub grinder 1 as described hereinabove, rotating the tub grinder hammermill 5 such that the arc of the hammers thereof enter the chamber or tub 8 so as to engage feed 147 positioned directly over the hammermill 5, rotating the tub 8 such that the feed 147 is selectively urged into a position over the hammermill 5, wherein the rotation of the tub 8 is slaved to the rotation of the hammermill 5. The method includes the step of delaying acceleration or increases in the speed of rotation of the tub 8 whenever the speed of rotation of the hammermill 5 accelerates. Therefore the rotation of the tub 8 decelerates upon the rotation of the hammermill 5 decelerating, thus feeding less feed 147 to the hammermill 5, thus reducing overloading thereof. But the rotation of the tub 8 accelerates on a delayed basis in relationship to the acceleration of the hammermill 5, thus allowing the hammermill 5 to reach a stable speed before substantially additional feed 147 is urged therein by the rotation of the tub 8, thereby reducing oscillations in the hammermill 5 due to overloading upon acceleration or startup thereof.

It is to be understood that while certain embodiments of the present invention have been illustrated and described herein, it is not to be limited to the specific forms or arrangement of parts described and shown. It is also understood that while certain directions have been used with reference to the embodiment illustrated, such as up, down, top, etc. the invention is not to be limited to these specific directions.

What is claimed and desired to secure by Letters Patent is:

1. Livestock feed tub grinding apparatus comprising:
(a) a rotating hammermill powered by a prime mover and a tub for holding feed and being rotated by power means slaved to said hammermill prime mover by a governor, said tub having a bottom, an aperture in said tub bottom wherethrough said feed is delivered to said hammermill; and
(b) a dampener associated with said governor; said dampener being operably connected to said tub rotation power means and decelerating same in direct relation to the deceleration of the rotation of said hammermill;
(c) said dampener further delaying the acceleration of said tub rotation means with respect to the acceleration of the rotation of said hammermill; whereby rotational speed of said tub decreases as soon as said hammermill becomes overloaded but rotational speed of said tub increases at a slower rate than said hammermill.

2. The apparatus according to claim 1 wherein:
(a) said dampener comprises a hydraulic ram.

3. The apparatus according to claim 2 wherein:
(a) said ram defines an enclosed cylinder having a piston mounted therein with a shaft on said piston extending beyond one end of said cylinder and being operably connected to said governor; said piston dividing said cylinder into first and second portions; said cylinder being filled with a hydraulic fluid; bypass device around said piston connecting said first and second portions, whereby flow of said hydraulic fluid through said bypass device, in a direction so as to allow movement of said piston to operably increases rotational speed of said tub is substantially slowed, thereby delaying said speed increase and whereby flow of said hydraulic fluid through said bypass device, in a direction so as to allow movement of said piston to operably decrease rotational speed of said tub is substantially unhampered.

4. The apparatus according to claim 3 wherein:
(a) said bypass device comprises a conduit having a check valve allowing one directional flow of said hydraulic fluid therein and an aperture in said piston of sufficiently small cross sectional area to allow a substantially reduced two directional flow of said hydraulic fluid as compared to said one directional flow through said check valve.

5. The apparatus according to claim 4 wherein:
(a) said tub rotation means comprises a motor;
(b) said governor includes:
(1) a transducer operatively sensing rotational speed of said hammermill; said transducer having a lever arm extending therefrom; said lever arm being selectively positioned by said transducer in relation to said rotational speed of the hammermill; and
(2) a bypass mechanism having bypass means therein; said bypass means being continuously urged to bypass power around said motor whereby rotation of said tub is decreased; said bypass means having a plunger associated therewith, depression of said plunger decreasing the bypass of power around said motor whereby rotation of said tub is increased; and
(c) said dampener includes:
(1) a base support fixedly positioned with respect to said transducer;
(2) an L-shaped arm having outwardly extending first and second members; and being pivotally mounted at the junction of said first and second members to said base support;
(3) the distal end of said first member being pivotally connected to said hydraulic cylinder piston;
(4) a resilient member connected to both the distal end of said second member and said lever arm, such that an increase in the rotational speed of said hammermill operates to reposition said lever arm and consequentially increases tension in said resilient member; and (5) a control rod having one end pivotally connected to said distal end of the second member; said control rod having an opposite end which engages said lever arm and said bypass mechanism plunger, such that when said lever arm is repositioned in response to a deceleration of said hammermill rotation, said control rod is positively urged by said lever arm away from said plunger whereby said power is bypassed around said tub motor and said tub rotation also decelerates, and such that when said lever arm is repositioned in response to acceleration of said hammermill rotation, said control rod is not positively urged by said lever arm but said lever arm increases tension on said resilient member which operatively increases pressure on said hydraulic cylinder piston, said hydraulic fluid being able to flow only through said aperture, whereby movement of said piston is hampered and consequently whereby movement of said control rod is hampered such that depression of said bypass mechanism plunger by said control rod is not in direct response to said increase in rotation of said hammermill, but rather, is delayed in response thereto, thereby also substantially delaying the increase in the rotation of said tub.

6. In a method of grinding livestock feed and the like comprising the steps of:

(a) placing said feed into a chamber having an aperture in the bottom thereof communicating with a hammermill positioned thereunder; said hammermill having hammers;

(b) rotating said hammers such that the arc of said hammers enters said chamber thereby grinding any of said feed positioned immediately above said aperture;

(c) rotating said chamber such that a portion of said feed is selectively urged into said position immediately above said aperture; said chamber rotation being slaved to said hammermill rotation, such that when said hammermill rotation increases, said chamber rotation also increases and, when said hammermill rotation decreases, said chamber rotation also decreases;

the improvement comprising the step of:

(a) delaying increases in said chamber rotation whenever said hammermill rotation increases, thereby reducing speed increase and decrease oscillations in said hammermill.

* * * * *